US006523002B1

(12) United States Patent
Gao et al.

(10) Patent No.: US 6,523,002 B1
(45) Date of Patent: Feb. 18, 2003

(54) SPEECH CODING HAVING CONTINUOUS LONG TERM PREPROCESSING WITHOUT ANY DELAY

(75) Inventors: Yang Gao, Mission Viejo, CA (US); Huan-yu Su, San Clemente, CA (US)

(73) Assignee: Conexant Systems, Inc., Newport Beach, CA (US)

( * ) Notice: Subject to any disclaimer, the term of this patent is extended or adjusted under 35 U.S.C. 154(b) by 0 days.

(21) Appl. No.: 09/410,218

(22) Filed: Sep. 30, 1999

(51) Int. Cl.[7] ..... G10L 11/04

(52) U.S. Cl. ..... 704/207; 704/219; 704/201; 704/221; 704/230

(58) Field of Search ..... 704/230, 221, 704/207, 201, 203, 219, 222, 223

(56) References Cited

U.S. PATENT DOCUMENTS

| | | | | | |
|---|---|---|---|---|---|
| 5,666,464 | A | * | 9/1997 | Serizawa | 704/207 |
| 5,704,003 | A | * | 12/1997 | Kleijn et al. | 704/220 |
| 6,104,992 | A | * | 8/2000 | Gao et al. | 704/220 |
| 6,173,257 | B1 | * | 1/2001 | Gao | 704/220 |
| 6,188,980 | B1 | * | 2/2001 | Thyssen | 704/230 |
| 6,223,151 | B1 | * | 4/2001 | Kleijn et al. | 704/207 |
| 6,260,010 | B1 | * | 7/2001 | Gao et al. | 704/230 |
| 6,330,533 | B2 | * | 12/2001 | Su et al. | 704/220 |

OTHER PUBLICATIONS

W. Bastiaan Kleijn, Ravi P. Ramachandran, and Peter Kroon, "Generalized Analysis–By–Synthesis Coding and its Application to Pitch Prediction", *ISHM 1992,* pp. I–337–I340.

TIA/EIA Interim Standard, "Enhanced Variable Rate Codec, Speech Service Option 3 for Wideband Spread Spectrum Digital Systems", TIA/EIA/IS–127, Jan. 1997.

* cited by examiner

*Primary Examiner*—Vijay Chawan
(74) *Attorney, Agent, or Firm*—Christopher J. Rourk; Akin Gump Strauss Hauer & Feld, LLP

(57) ABSTRACT

A zero delay continuous long term (LT) pre-processing method operable in a speech codec that introduces no delay. The present invention provides an elegant solution to perform long term (LT) pre-processing of the pitch lag of a speech signal to save a large number of bits required in various speech coding methods, including the code-excited linear prediction method. The present invention is ideal for speech coding standards and methods that any undesirable delay at the end of a speech frame of the speech signal. The present invention overcomes a significant limitation in the art of speech coding, in that, a speech coding system that performs the invention is operable while providing real time operation and introducing no delay whatsoever. In addition, the perceptual quality of a reproduced speech signal, as reproduced in accordance with the invention, is of a high quality and substantially perceptually indistinguishable from that provided using the traditional and conventional long term processing (LTP) of the pitch lag. The traditional and conventional long term processing (LTP) of the pitch lag inherently requires significantly more bits to perform the speech coding of the pitch lag of the speech signal.

20 Claims, 8 Drawing Sheets

Sub-frame Residual Modification/Warping

SPEECH CODING HAVING CONTINUOUS LONG TERM PREPROCESSING WITHOUT ANY DELAY

BACKGROUND

1. Technical Field

The present invention relates generally to speech coding; and, more particularly, it relates to long term pre-processing of speech coding without any delay.

2. Related Art

Conventional long term (LT) pre-processing in a code-excited linear prediction speech coding saves a number of bits to code a pitch lag of a speech signal, but the conventional methods to perform long term (LT) pre-processing inherently introduces a variable delay at an end of a speech frame of the speech signal. No conventional speech coding method provides any way to perform long term (LT) pre-processing to code the pitch lag of a speech signal without performing some form of extra-delay at an end of a speech frame.

Further limitations and disadvantages of conventional and traditional systems will become apparent to one of skill in the art through comparison of such systems with the present invention as set forth in the remainder of the present application with reference to the drawings.

SUMMARY OF THE INVENTION

Various aspects of the present invention can be found in a speech codec having a pitch track coding circuitry that operates on a speech signal. The pitch track coding circuitry of the speech codec itself contains, among other things, a pitch lag selection circuitry and a residual (or weighted speech) modification and warping circuitry. The pitch lag selection circuitry selects an end-of-frame pitch lag. The end-of-frame pitch lag is selected from a speech frame of the speech signal. The first pitch lag determines a global pitch track for the speech frame using the end-of-frame pitch lag. The residual (or weighted speech) modification and warping circuitry adjusts a local pitch track of the speech frame on a speech sub-frame basis. The sub-frame size could be variable. The speech signal contains a number of speech frames. Each speech frame of the number of speech frames itself contains a number of speech sub-frames. Each speech sub-frame of the number of speech sub-frames has a corresponding pitch lag. The residual modification and warping circuitry adjusts the corresponding pitch lag.

In certain embodiments of the invention, a speech coding residual is received by the pitch lag selection circuitry. The speech coding residual is used to calculate an open-loop pitch, and the open-loop pitch is used to select the end-of-frame pitch lag. If desired, the end-of-frame pitch lag is searched by maximizing a long term processing gain of the speech frame of the speech signal. In this embodiment of the invention, the end-of-frame pitch lag is searched by favoring a long term processing gain close to an end of the speech frame of the speech signal. In other embodiments of the invention, each speech frame of the number of speech frames of the speech signal contains two end-points, and the end-points of each of the speech frames are not adjusted by the residual modification and warping circuitry. Also, each speech frame of the plurality of speech frames of the speech signal contains a number of internal-points. The corresponding pitch lags of the number of speech sub-frames of the number of speech frames of the speech signal is a pitch lag corresponding to one of the internal-points. The pitch lag corresponding to one of the plurality of internal-points is adjusted using the residual modification and warping circuitry. In addition, a long term processing gain for all the speech sub-frames of the speech frame of the speech signal is maximized to assist in the determination of the adjustment of the at least one of the corresponding pitch lags of the number of speech sub-frames of the number of speech frames of the speech signal by the residual modification and warping circuitry. In certain embodiments of the invention, more than one pitch lag of the number of speech signal of the number of speech frames of the speech signal is adjusted using the residual modification and warping circuitry. The adjustment at the end of the frame is kept to zero. The speech codec of the invention contains an encoder circuitry, and the adjustment of the pitch lags of the number of speech sub-frames of the number of speech frames of the speech signal is performed exclusively in an encoder circuitry of the speech codec.

Other aspects of the present invention can be found in a speech codec having a pitch track coding circuitry that operates on a speech signal. In this embodiment of the invention, the speech codec contains a pitch lag selection circuitry and a residual modification and warping circuitry. The pitch lag selection circuitry selects a first pitch lag for a speech frame of the speech signal. The first pitch lag determines a global pitch track for the speech frame. The residual modification and warping circuitry adjusts a local pitch track of the speech frame on a speech sub-frame basis. The local pitch track of the speech frame is adjusted by modifying and warping a selected number of points within the speech frame.

In certain embodiments of the invention, the speech codec contains an encoder circuitry, and the adjustment of the pitch lags of the plurality of the number of speech sub-frames of the number of speech frames of the speech signal is performed exclusively in the encoder circuitry of the speech codec. Each speech frame of the number of speech frames of the speech signal has two end-points. The end-points of each of the speech frames are not adjusted by the residual modification and warping circuitry. The selected first pitch lag for the speech frame of the speech signal is selected by maximizing a long term processing gain of the speech frame of the speech signal and by favoring a long term processing gain close to an end of the speech frame of the speech signal. The total adjustment of the selected plurality of points within the speech frame sums to zero.

Other aspects of the present invention can be found in a method that modifies and warps a speech coding residual of a speech signal (or weighted speech signal). The method includes calculating the speech coding residual of the speech signal so that the speech coding residual contains an initial estimate of pitch track. In addition, the method includes determining an initial estimate for a pitch track of the speech signal, and modifying and warping the speech coding residual to provide a better fit of the pitch track of the speech coding residual.

In certain embodiments of the invention that perform the method, the speech signal contains a number of speech frames. Each speech frame of the speech signal contains a plurality of speech sub-frames. The step of the method that determined the initial estimate for the pitch track of the speech signal further includes maximizing a long term processing gain for the number of speech frames of the speech signal. In doing this, a long term processing gain close to an end of the speech frame of the speech signal is favored. In other embodiments of the invention, the modification and warping of the speech coding residual to provide the better fit of the pitch track of the speech coding residual further includes maximizing a long term processing gain of the plurality of speech sub-frames of the speech signal. In doing this, each speech frame of the number of speech frames of the speech signal has two end-points. The end-points of each of the speech frames are not modified and warped to provide a better fit of the pitch track of the speech coding residual.

Other aspects, advantages and novel features of the present invention will become apparent from the following detailed description of the invention when considered in conjunction with the accompanying drawings.

DETAILED DESCRIPTION OF THE INVENTION

Figure 1:
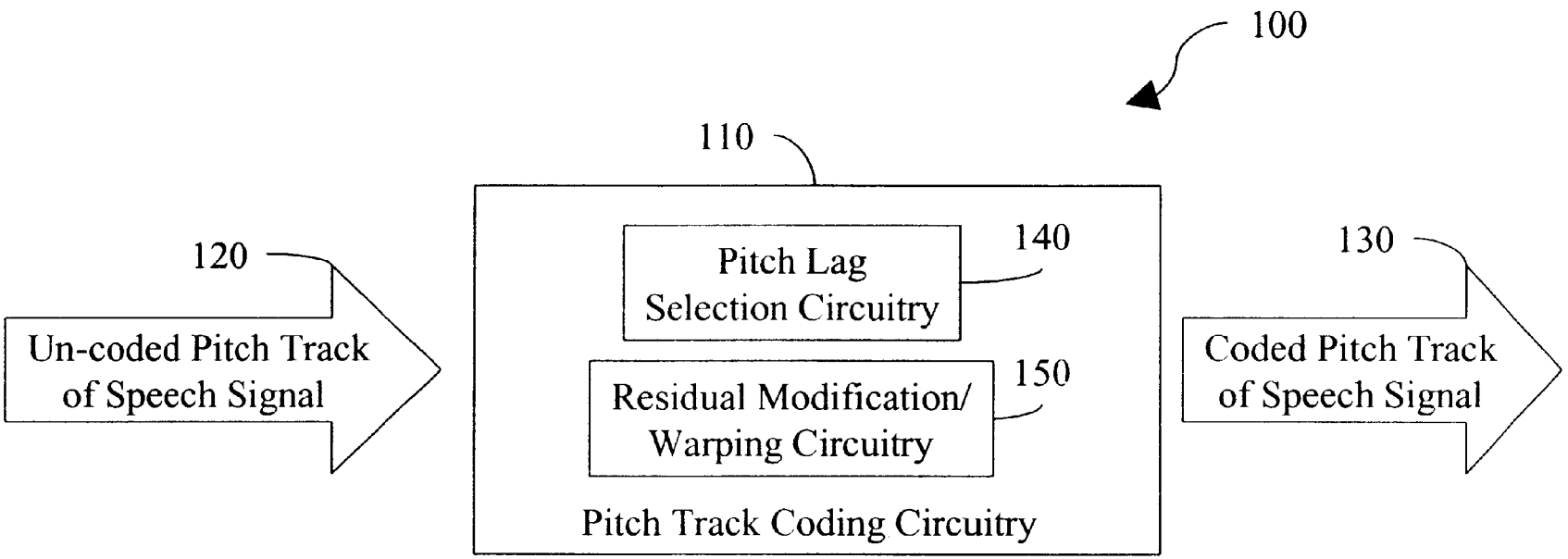
FIG. 1 is a system diagram illustrating one embodiment of the invention that is a speech coding system that performs long term (LT) pre-processing.

FIG. 1 is a system diagram illustrating one embodiment of the invention that is a speech coding system 100 that performs long term (LT) pre-processing. The speech coding system 100 contains, among other things, a pitch track coding circuitry 110. The pitch track coding circuitry 110 converts an un-coded pitch track of a speech signal 120 into a coded pitch track of a speech signal 130. The pitch track coding circuitry 110 itself contains, among other things, a pitch lag selection circuitry 140 and a residual modification/warping circuitry 150. The pitch lag selection circuitry 140 of the pitch track coding circuitry 110 selects an initial estimate of the pitch track of the speech signal. From one perspective, the pitch lag selection circuitry 140 is viewed as determining the end-points and the global trajectory of the pitch track of the speech signal within a selected speech frame of the speech signal.

However, the local trajectory of the of the pitch track of the speech signal within the selected speech frame of the speech signal is subsequently modified/warped using the residual modification/warping circuitry 150. Specifically, after the initial guess and trajectory of the pitch track of the speech signal is chosen using the pitch lag selection circuitry 140, the residual modification/warping circuitry 150 modifies/warps the local trajectory of the pitch track of the speech signal on a speech sub-frame basis. That is to say, within individual speech sub-frames of the speech signal, the local pitch track of the un-coded pitch track of a speech signal 120 is modified so that the local pitch track of the coded pitch track of a speech signal 130 provides a very high perceptual quality within a speech signal during reproduction.

Figure 2:
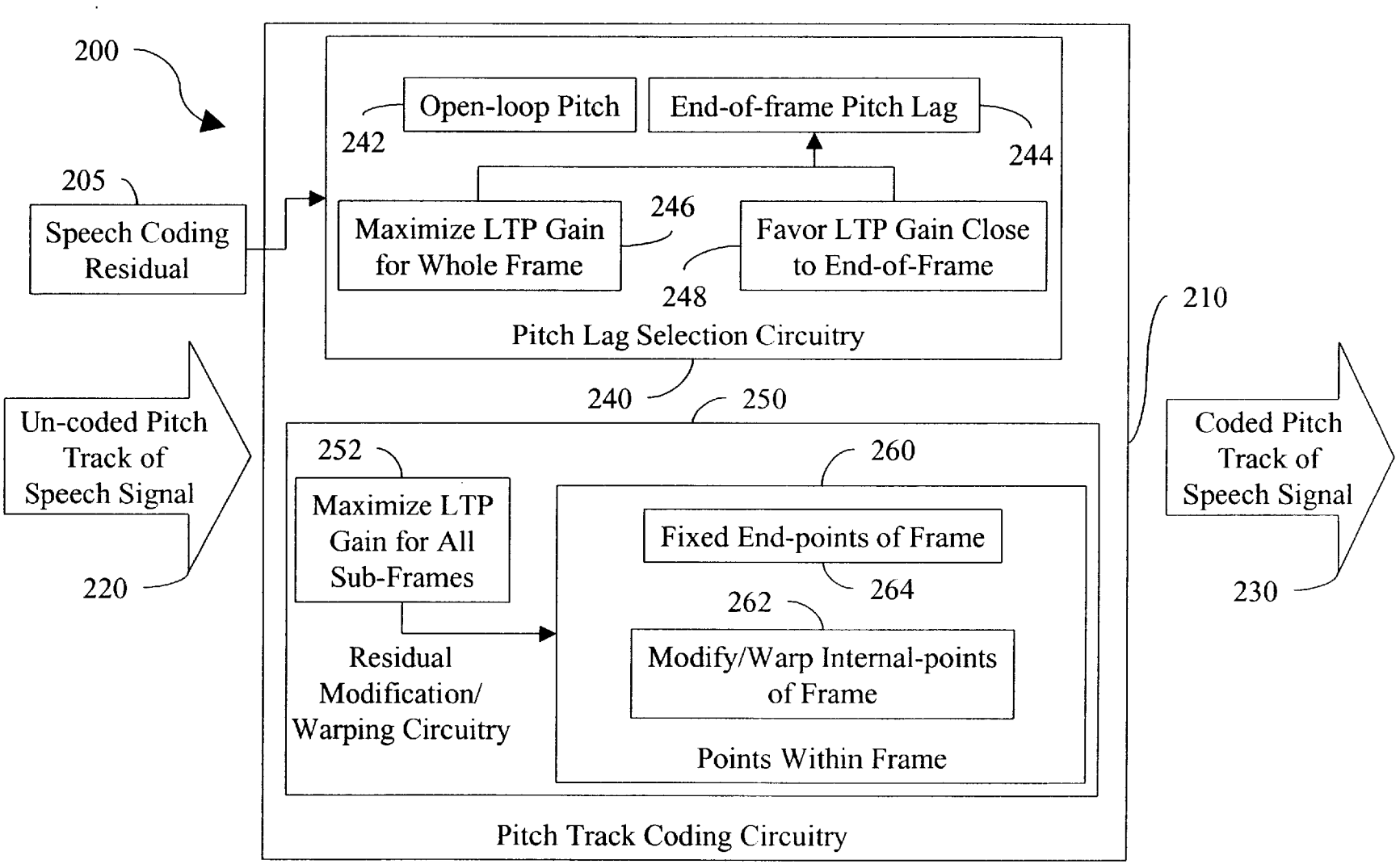
FIG. 2 is a system diagram illustrating a specific embodiment of the invention of FIG. 1 that is a speech coding system that performs long term (LT) pre-processing.

FIG. 2 is a system diagram illustrating a specific embodiment of the invention of FIG. 1 that is a speech coding system 200 that performs long term (LT) pre-processing. The speech coding system 200 contains, among other things, a pitch track coding circuitry 210, and the speech coding system 200 receives a speech coding residual 205. Similar to the speech coding system 100 illustrated in FIG. 1, the pitch track coding circuitry 210 converts an un-coded pitch track of a speech signal 220 into a coded pitch track of a speech signal 230. The pitch track coding circuitry 210 itself contains, among other things, a pitch lag selection circuitry 240 and a residual modification/warping circuitry 250. The speech coding residual 205 is provided first to the pitch lag selection circuitry 240 of the pitch track coding circuitry 210. Using the speech coding residual 205, the pitch lag selection circuitry 240 calculates an open-loop pitch 242. Then, the precise pitch lag at the end of a speech frame is searched using the pitch lag selection circuitry 240. An end-of-frame pitch lag 244 is the result of this searching performed by the pitch lag selection circuitry 240. In certain embodiments of the invention, to find the end-of-frame pitch lag 244, the pitch lag selection circuitry 240 employs a function that maximizes a long term processing (LTP) gain for a whole frame 246 and a function that favors a long term processing (LTP) gain close to an end-of-frame 248. Once the end-of-frame pitch lag 244 is found using the pitch lag selection circuitry 240, the end-points of a speech sub-frame of the speech signal are determined, and they remain fixed.

Subsequently, modification/warping is performed on the internal-points contained within the speech sub-frames of the speech frame of the speech signal using the residual modification/warping circuitry 250. In doing this modification/warping, the residual modification/warping circuitry 250 selects a plurality of points within a frame 260. As described above, the end-points of a speech sub-frame of the speech signal are determined, and they remain fixed. In this particular embodiment of the invention, the end-points of a speech sub-frame of the speech signal that are fixed are the end-points of the frame that are fixed 264. The modification/warping that is performed by the residual modification/warping circuitry 250 on the plurality of points within a frame 260 is specifically performed on a number of internal-points of the frame that are modified/warped 262. If desired, the decision making that performs the modification/warping of the number of internal-points of the frame that are modified/warped 262 is performed using a function that maximizes a long term processing (LTP) gain for all the sub-frames within a frame 252.

Figure 3:
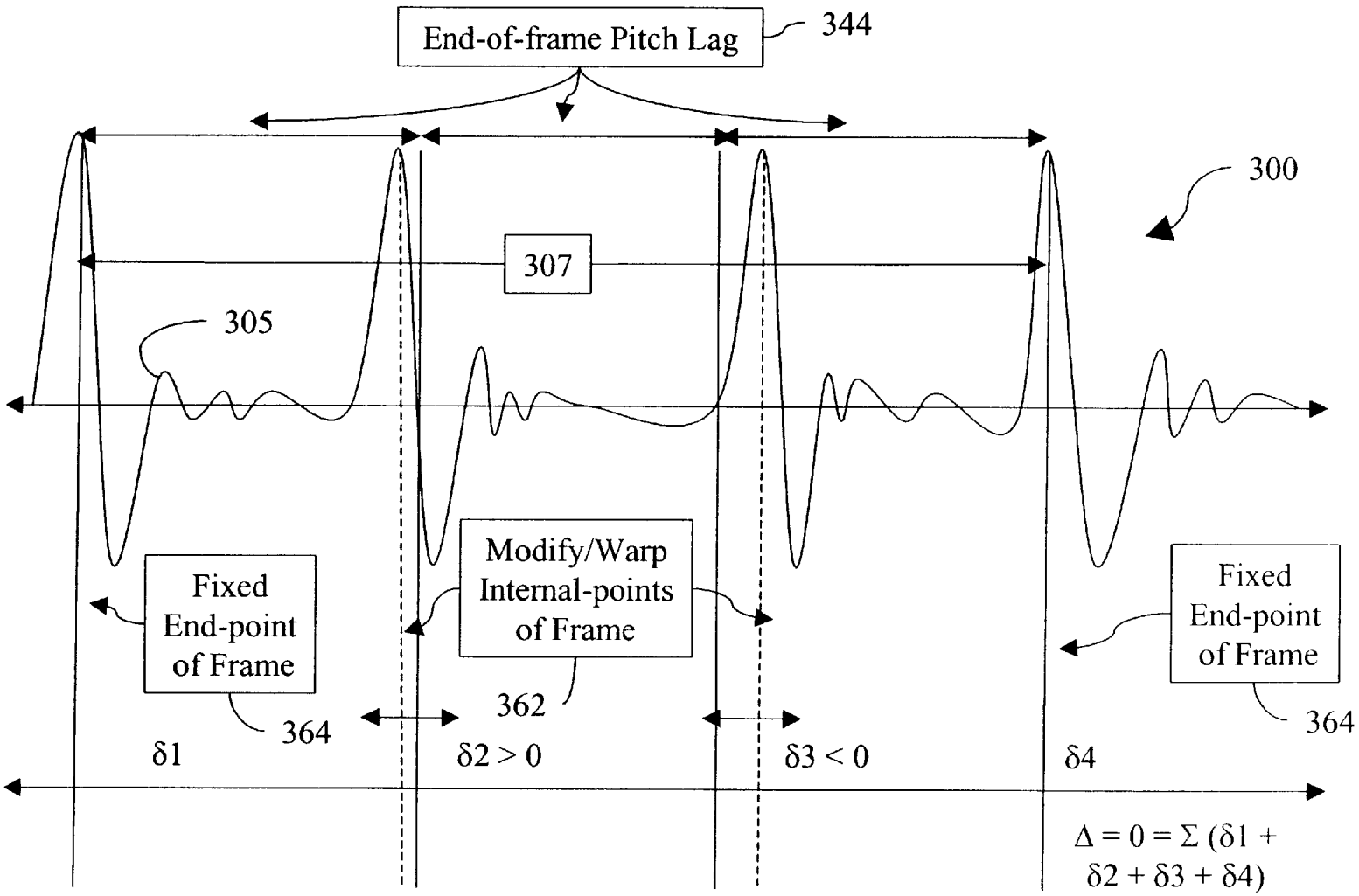
FIG. 3 is speech signal diagram illustrating residual modification and warping that is performed in accordance with the invention on a sub-frame basis of the speech signal.

FIG. 3 is speech signal diagram illustrating residual modification and warping 300 that is performed in accordance with the invention on a sub-frame basis of the speech signal. A speech signal 305 is partitioned such that a speech frame 307 is selected for long term (LT) pre-processing in accordance with the invention. Initially, a speech coding residual is calculated. From this calculation, an open-loop pitch is then calculated for the speech frame 307. Subsequently, after the speech frame 307 is partitioned into a plurality of speech sub-frames, the precise pitch lag at the end of the speech frame 307 is determined. That is to say, the pitch lag for the last speech sub-frame of the speech frame 307 is used to control the coded pitch track of the current speech frame, the speech frame 307 that is selected for long term (LT) pre-processing in accordance with the invention. This precise pitch lag at the end of the speech frame 307 is searched by maximizing a long term processing (LTP) gain for the entire speech frame 307. The long term processing (LTP) gain close to the end of the speech frame 307 is favored during this searching step. An end-of-frame pitch lag 344 is chosen at this point. The entire speech frame 307 is partitioned into a number of speech sub-frames, each one initially having the end-of-frame pitch lag 344. Thereafter, after the precise pitch lag at the end of the speech frame 307 security interest found, the speech coding residual is modified for better fitting of the speech coded pitch track within the speech frame 307. A predetermined number of points within the speech frame 307 are chosen for long term (LT) pre-processing. In the specific embodiment of the invention shown in FIG. 3, two end-points (δ1 and δ4) 364 remain fixed. The end-points (δ1 and δ4) 364 of the speech frame require no modification/warping. They remain fixed during the long term (LT) pre-processing performed in accordance with the invention. However, the remaining internal-points (δ2 and δ3) 362 of the speech frame 307 are continuously modified/warped. The remaining internal-points (δ2 and δ3) 362 of the speech frame 307 are modified/warped such that the best speech coding residual is chosen by maximizing the long term processing (LTP) gain for all the speech sub-frames within the current speech frame, namely the speech frame 307.

The internal-points (δ2 and δ3) 362 of the speech frame 307 are modified/warped. More specifically, the internal-points (δ2 and δ3) 362 are modified at the points where the frame is partitioned into a number of speech sub-frames. In the particular embodiment shown by the residual modification and warping 300, one of the internal-points of the speech frame (δ2>0) is modified to in one direction while another of the internal-points of the speech frame (δ3<0). That is to say, during long term (LT) pre-processing wherein the initial guess of the end-of-frame pitch lag 344 for all of the speech sub-frames within the speech frame 307 is slightly modified/warped. In this particular embodiment of the invention, δ1 and δ4 must be zero. δ2 and δ3 are any limited value because it is based on continuous warping. In other embodiments of the invention, any number of intervening internal-points are contained between the two end-points within the speech sub-frame.

The modification/warping of the actual pitch lag for each of the speech sub-frames within the speech frame 307 provides a greater perceptual quality of the speech signal 305 during reproduction of the speech signal 305. Moreover, the long term (LT) pre-processing performed in accordance with the invention saves a large number of bits within speech coding while the perceptual quality of a reproduced speech signal is perceptually indistinguishable from a speech signal reproduced using conventional long term processing (LTP) that intrinsically requires significantly more bits to code the pitch lag.

Figure 4:
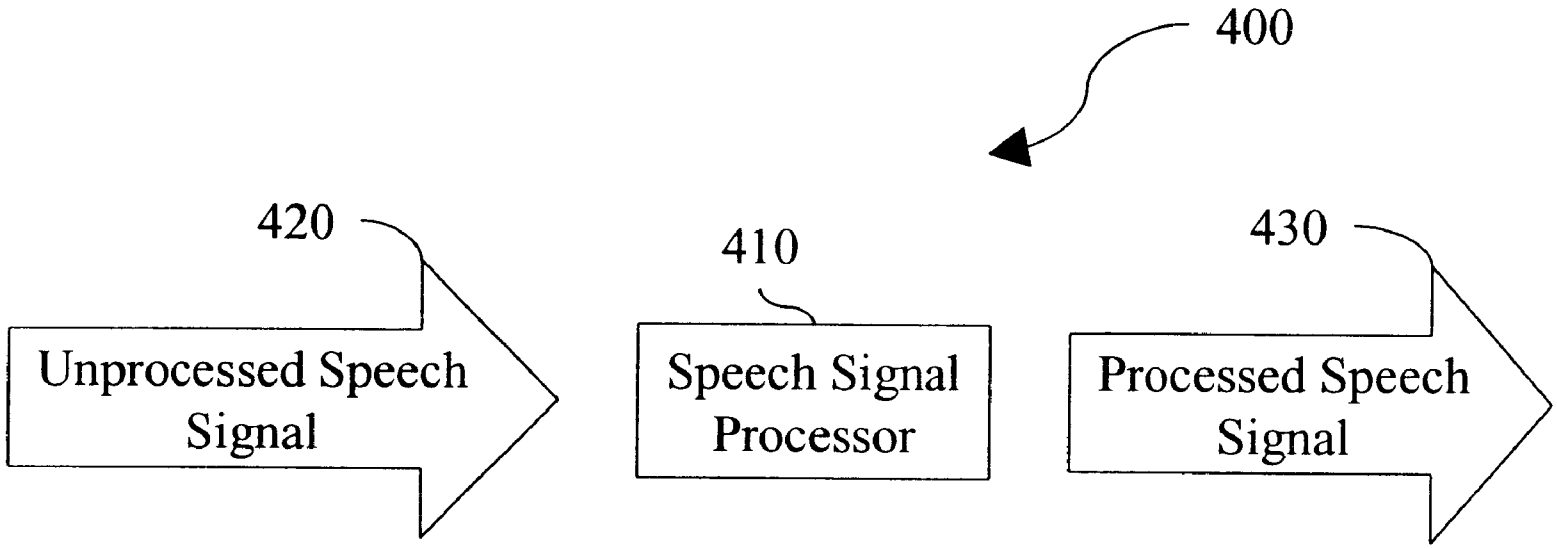
FIG. 4 is a system diagram illustrating an embodiment of a speech signal processing system built in accordance with the present invention.

FIG. 4 is a system diagram illustrating an embodiment of a speech signal processing system 400 built in accordance with the present invention. Within FIG. 4, a speech signal processor 410 built is in accordance with the present invention. The speech signal processor 410 receives an unprocessed speech signal 420 and produces a processed speech signal 430.

In certain embodiments of the invention, the speech signal processor 410 is processing circuitry that performs the loading of the unprocessed speech signal 420 into a memory from which selected portions of the unprocessed speech signal 420 are processed in a sequential manner. The processing circuitry possesses insufficient processing capability to handle the entirety of the unprocessed speech signal 420 at a single, given time. The processing circuitry may employ any method known in the art that transfers data from a memory for processing and returns the processed speech signal 430 to the memory. In other embodiments of the invention, the speech signal processor 410 is a system that converts a speech signal into encoded speech data. The encoded speech data is then used to generate a reproduced speech signal perceptually indistinguishable from the speech signal using speech reproduction circuitry. In other embodiments of the invention, the speech signal processor 410 is a system that converts encoded speech data, represented as the unprocessed speech signal 420, into the reproduced speech signal, represented as the processed speech signal 430. In other embodiments of the invention, the speech signal processor 410 converts encoded speech data that is already in a form suitable for generating a reproduced speech signal perceptually indistinguishable from the speech signal, yet additional processing is performed to improve the perceptual quality of the encoded speech data for reproduction.

The speech signal processing system 400 is, in some embodiments, the speech coding system 100 that performs long term (LT) pre-processing or, alternatively, the speech coding system 200 that performs long term (LT) pre-processing, as described in the FIGS. 1 and 2, respectively. The speech signal processor 410 operates to convert the unprocessed speech signal 420 into the processed speech signal 430. The conversion performed by the speech signal processor 410 may be viewed as taking place at any interface wherein data must be converted from one form to another, i.e. from speech data to coded speech data, from coded data to a reproduced speech signal, etc.

Figure 5:
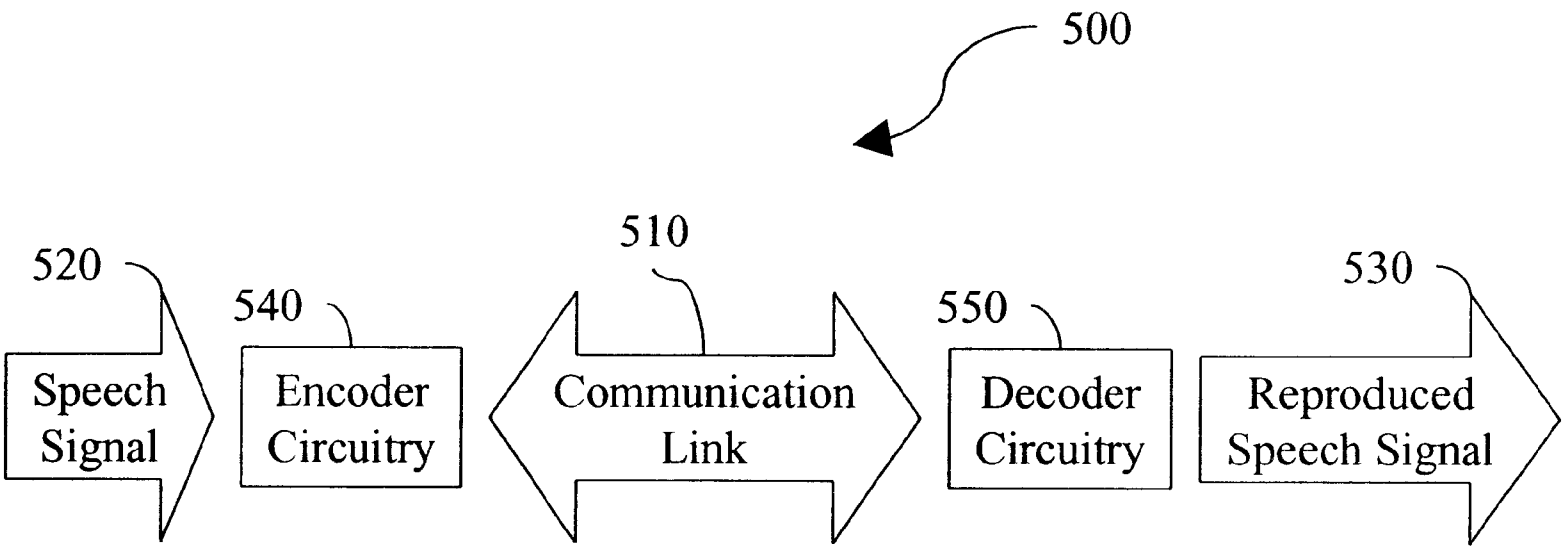
FIG. 5 is a system diagram illustrating an embodiment of a speech codec built in accordance with the present invention that communicates using a communication link.

FIG. 5 is a system diagram illustrating an embodiment of a speech codec 500 built in accordance with the present invention that communicates across a communication link. FIG. 5 is a system diagram illustrating an embodiment of a speech codec 500 built in accordance with the present invention that communicates using a communication link 510. A speech signal 520 is input into an encoder circuitry 540 in which it is coded for data transmission via the communication link 510 to a decoder circuitry 550. The decoder processing circuit 550 converts the coded data to generate a reproduced speech signal 530 that is substantially perceptually indistinguishable from the speech signal 520.

In certain embodiments of the invention, the decoder circuitry 550 includes speech reproduction circuitry. Similarly, the encoder circuitry 540 includes selection circuitry that is operable to select from a plurality of coding modes. The communication link 510 is either a wireless or a wireline communication link without departing from the scope and spirit of the invention. The encoder circuitry 540 identifies at least one perceptual characteristic of the speech signal and selects an appropriate speech signal coding scheme depending on the at least one perceptual characteristic. The at least one perceptual characteristic is a substantially music-like signal in certain embodiments of the invention. The speech codec 500 is, in one embodiment, a multi-rate speech codec that performs speech coding on the speech signal 520 using the encoder circuitry 540 and the decoder circuitry 550.

In certain embodiments of the invention, the adjustment of the pitch lags corresponding to the speech sub-frames that modifies the local pitch track of the speech signal, as described above in accordance with the invention, is performed exclusively within the encoder circuitry 540 of the speech codec 500.

Figure 6:
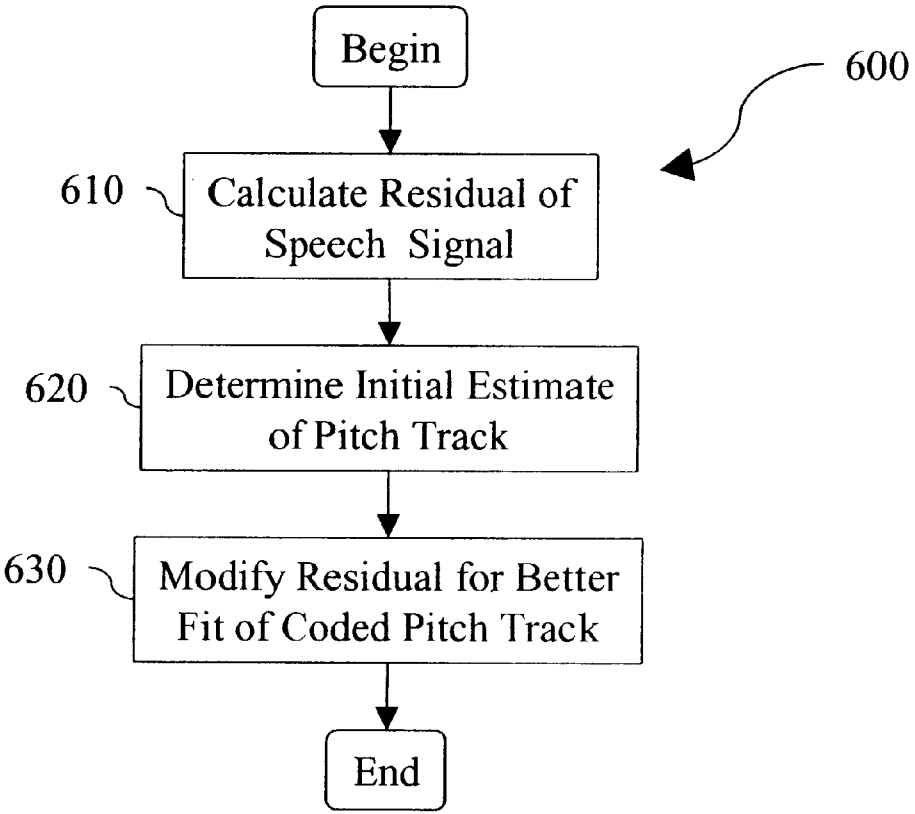
FIG. 6 is a functional block diagram illustrating a speech signal coding method performed in accordance with the present invention.

FIG. 6 is a functional block diagram illustrating a speech signal coding method 600 performed in accordance with the present invention. In a block 610, a speech coding residual is calculated for a speech signal. Subsequently, in a block 620, an initial estimate of a pitch track is determined for the speech signal. Afterwards, in a block 630, the speech coding residual is modified using the long term (LT) pre-processing performed in accordance with the invention for a better fit of the coded pitch track within the speech signal.

Figure 7:
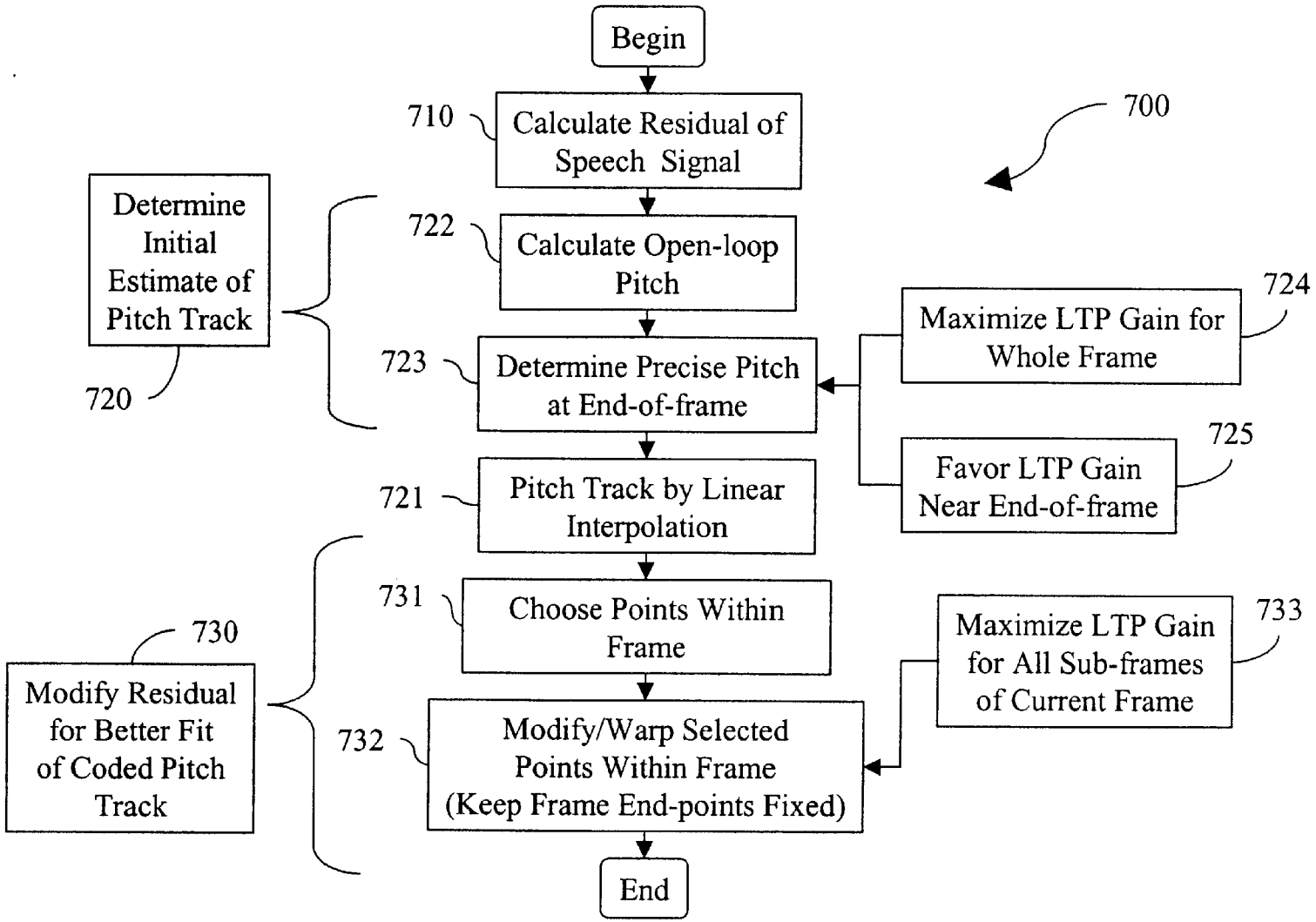
FIG. 7 is a functional block diagram illustrating a specific embodiment of the speech signal coding method of FIG. 6 that is performed in accordance with the present invention.

FIG. 7 is a functional block diagram illustrating a method 700 that is a specific embodiment of the speech signal coding method of FIG. 6 that is performed in accordance with the present invention. In a block 710, a speech coding residual is calculated for a speech signal. Subsequently, in a block 720, an initial estimate of a pitch track is determined for the speech signal. Afterwards, in a block 730, the speech coding residual is modified using the long term (LT) pre-processing performed in accordance with the invention for a better fit of the coded pitch track within the speech signal.

In certain embodiments of the invention, the operations performed in the block 720 include a number of additional and more specific operations within the method 700. In a block 722, an open-loop pitch is calculated for the speech signal whose speech coding residual is calculated in the block 710. Subsequently, a precise end-of-frame pitch is determined in a block 723. If desired, to assist in the determination of the precise end-of-frame pitch within the block 723, a long term processing (LTP) gain is maximized for a whole frame of the speech signal. In addition, an long term processing (LTP) gain near an end-of-frame is favored. That is to say, near the end of the speech frame of the speech signal on which the method 700 is being performed, is favored to be selected. Subsequently, in a block 721, the pitch track of the speech signal is modified using linear interpolation.

Similarly, in certain embodiments of the invention, the operations performed in the block 730 include a number of additional and more specific operations within the method 700. In a block 731, a number of points within a speech frame of the speech signal are chosen for modification/warping using long term (LT) pre-processing performed in accordance with the invention. Subsequently, in a block 732, the points within the speech frame that are selected in the block 731 are modified/warped within the speech frame. In doing the operation performed within the block 732, the end-points of the speech frame remain fixed in place, and only a selected number of internal-points of the speech frame are modified/warped. If desired, a long term processing (LTP) gain for all the speech sub-frames of the current speech frame is used to provide an intelligent modification/warping of the internal-points of the speech frame.

Figure 8:
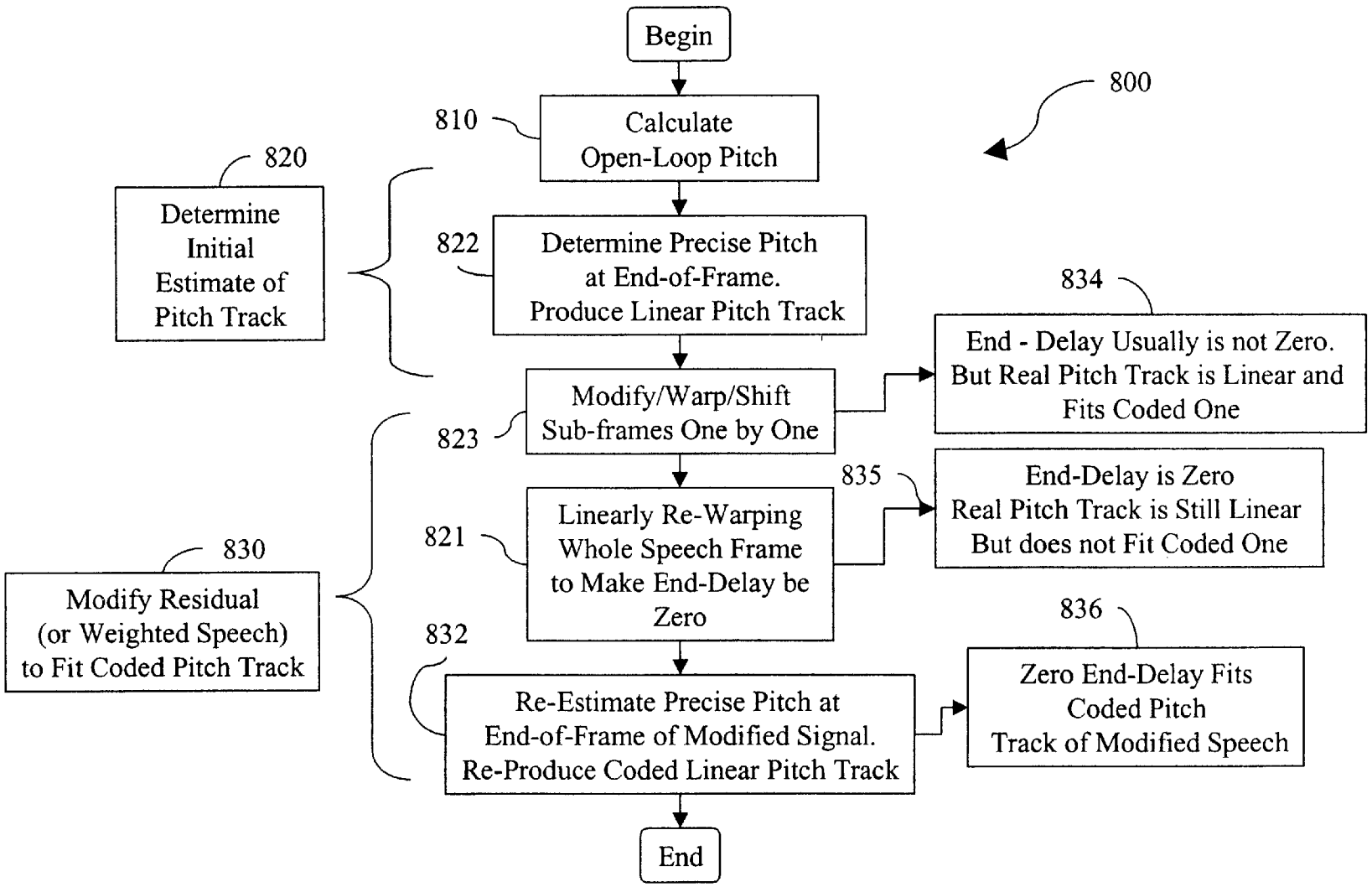
FIG. 8 is a functional block diagram illustrating a specific embodiment of the speech signal coding method of FIG. 6 that is performed in accordance with the present invention.

FIG. 8 is a functional block diagram illustrating a method 800 that is a specific embodiment of the speech signal coding method of FIG. 6 that is performed in accordance with the present invention. In a block 820, an initial estimate of a pitch track is estimated, and in a block 830, a residual (or weighted speech signal) is modified to fit a coded pitch track. The operations performed within the block 820 are provided in more detail within the blocks 810 and 822. In a block 810, an open-loop pitch is calculated. Subsequently, in a block 822, a precise pitch at an end-of-frame of the speech signal is determined to produce a linear pitch track.

Similarly, the operations performed within the block 830 are provided in more detail within the blocks 832, 821, 832, 834, 835, and 836. In a block 823, a number of speech sub-frames are modified/warped/shifted in accordance with any of the embodiments described above within the invention. In certain embodiments of the invention, in a block 834, though the end-delay is usually not zero, the real pitch track is linear and fits the coded pitch track. Subsequent to the operation in the block 823, the entire speech frame is re-warped in a linear manner to make an end-delay of the speech frame to be zero in a block 821. In certain embodiments of the invention, in a block 835, when the end-delay is in fact zero, the real pitch track of the speech signal is still linear, but it does not fit the coded pitch track. Subsequent to the operation in the block 821, the precise pitch track is re-estimated at the end-of-frame of the modified speech signal to re-produce a coded linear pitch track. In certain embodiments of the invention, in a block 836, the zero end-delay fits the coded pitch track of the modified speech signal.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A speech codec having a pitch track coding circuitry that operates on a speech signal, the pitch track coding circuitry of the speech codec comprising:

a pitch lag selection circuitry that selects an end-of-frame pitch lag, the end-of-frame pitch lag is selected from a speech frame of the speech signal, the pitch lag selection circuitry determines a global pitch track for the speech fame using the end-of-frame pitch lag;

a residual modification and warping circuitry that adjusts a local pitch track of the speech frame on a speech sub-fame basis; and wherein the speech signal comprises a plurality of speech frames, each speech frame of the plurality of speech frames contains a plurality of speech sub-frames, each speech sub-frame of the plurality of speech sub-frames has a corresponding pitch lag, the residual modification and warping circuitry adjusts at least one of the corresponding pitch lags.

2. The pitch track coding circuitry of the speech codec of claim 1, wherein a speech coding residual is received by the pitch lag selection circuitry, the speech coding residual is used to calculate an open-loop pitch, and the open-loop pitch is used to select the end-of-fame pitch lag.

3. The pitch track coding circuitry of the speech codes of claim 1, wherein the end-of-frame pitch lag is searched by maximizing a long term processing gain of the speech frame of the speech signal.

4. The pitch track coding circuitry of the speech codec of claim 3, wherein the end-of-frame pitch lag is searched by favoring a long tern processing gain close to an end of the speech frame of the speech signal.

5. The pitch track coding circuitry of the codec of claim 1, wherein each speech frame of the plurality of speech frames of the speech signal comprises two end-points, and the end-points of each of speech frames are not adjusted by the residual modification and warping circuitry.

6. The pitch neck coding circuitry of the speech codec of claim 1, wherein each speech frame of the plurality of speech frames of the speech signal comprises a plurality of internal-points; and wherein the at least one of the corresponding pitch lags of the plurality of speech sub-frames of the plurality of speech frames of the speech signal is a pitch lag corresponding to one of the plurality of internal-points, the pitch lag corresponding to one of the plurality of internal-points is adjusted using the residual modification and warping circuitry.

7. The pitch neck coding circuitry of speech codec of claim 1, wherein a long term processing gain for all the speech sub-frames of the speech frame of the speech signal is maximized to assist in the determination of the adjustment of the at least one of the corresponding pitch lags of the plurality of speech sub-frames of the plurality of speech frames of the speech signal by the residual modification and warping circuitry.

8. The pitch track coding circuitry of the speech codec of claim 1, wherein at least one additional of the corresponding pitch lags of the plurality of speech sub-frames of the plurality of speech frames of the speech signal is adjusted using the residual modification and warping circuitry, and the total adjustment of the at least one of the corresponding pitch lags and the at least one additional of the corresponding pitch lags sums to zero.

9. The pitch track coding circuitry of the speech codec of claim 1, wherein the speech codec comprises an encoder circuitry; and the adjustment of the at least one of the corresponding pitch lags of the plurality of speech sub-frames of the plurality of speech frames of the speech signal is performed exclusively in the encoder circuitry of the speech codec.

10. A speech codec having a pitch track coding circuitry that operates on a speech signal, the pitch track coding circuitry of the speech codec comprising:

a pitch lag selection circuitry that selects a first pitch lag for a speech frame of the speech signal, the first pitch lag determines a global pitch track for the speech frame; and a residual modification and warping circuitry that adjusts a local pitch track of the speech frame an a speech sub-frame basis, the local pitch track of the speech frame is adjusted by modifying and warping a selected plurality of points within the speech frame.

11. The pitch track coding circuitry of the speech codec of claim 10, wherein the speech codec comprises an encoder circuitry; and the adjustment of the at least one of the corresponding pitch lags of the plurality of speech sub-frames of the plurality of speech frames performed of the speech signal is performed exclusively in an encoder circuitry of the speech codec.

12. The pitch track coding circuitry of the speech codec of claim 10, wherein each speech frame of the plurality of speech frames of the speech signal comprises two end-points, and the end-points of each of the speech frames are not adjusted by the residual modification and warping circuitry.

13. The pitch track coding circuitry of the speech codec of claim 10, wherein the selected fast pitch lag for the speech flame of the speech signal is selected by maximizing a long term processing gain of the speech frame of the speech signal.

14. The pitch track coding circuitry of the speech codec of claim 13, wherein the selected first pitch lag for the speech frame of the speech signal is selected by favoring a long term processing gain close to an end of the speech frame of the speech signal.

15. The pitch track coding circuitry of the speech codec of claim 10, wherein the selected plurality of points within the speech frame is adjusted using the residual modification and warping circuitry, and the total adjustment of the selected plurality of points within the speech frame sums to zero.

16. A method that modifies and wraps a speech coding residual of a speech signal, the method comprising:

calculating the speech coding residual of the speech signal, the speech coding residual contains an initial estimate of pitch track;

determining an initial estimate for a pitch track of the speech signal; and modifying and warping the speech coding residual on a speech sub-frame basis to provide a better fit of the pitch track of the speech coding residual.

17. The method of claim 16, wherein the speech signal contains a plurality of speech frames, each speech frame of the speech signal contains a plurality of speech sub-frames; and the determining the initial estimate for the pitch track of the speech signal further comprises maximizing a long term processing gain for the plurality of speech francs of the speech signal.

18. The method of claim 17, wherein the speech signal contains a plurality of speech frames, each speech frame of the speech signal contains a plurality of speech sub-frames; and the determining the initial estimate for the pitch track of the speech signal further comprises favoring a long term processing gain close to an end of the speech frame of the speech signal.

19. The method of claim 16, wherein the speech signal contains a plurality of speech frames, each speech frame of the speech signal contains a plurality of speech sub-frames; and the modifying and warping of the speech coding residual to provide the better fit of the pitch track of the speech coding residual further comprises maximizing a long term processing gain of the plurality of speech sub-frame of the speech signal.

20. The method of claim 19, wherein the speech signal contains a plurality of speech frames, each speech frame of the speech signal contains a plurality of speech sub-frames; and wherein each speech frame of the plurality of speech frames of the speech signal comprises two end-points, and the end-points of each of the speech frames are not modified and warped to provide a better fit of the pitch track of the speech coding residual.

* * * * *

UNITED STATES PATENT AND TRADEMARK OFFICE

CERTIFICATE OF CORRECTION

PATENT NO. : 6,523,002 B1
DATED : February 18, 2003
INVENTOR(S) : Gao et al.

It is certified that error appears in the above-identified patent and that said Letters Patent is hereby corrected as shown below:

Column 8,
Line 33, replace “fame”, with -- frame --.
Line 49, replace “codes” with -- codec --.
Line 57, before “codec” add -- speech --.
Line 62, replace “neck” with -- track --.

Column 9,
Line 6, replace “neck” with -- track --.
Line 46, delete “performed”.
Line 57, replace “flame” with -- frame --.

Column 10,
Line 29, replace “francs” with -- frames --.
Line 48, replace “frame” with -- frames --.

Signed and Sealed this

Sixth Day of May, 2003

JAMES E. ROGAN
*Director of the United States Patent and Trademark Office*